United States Patent [19]

Banich, Sr.

[11] Patent Number: 5,027,964

[45] Date of Patent: Jul. 2, 1991

[54] CLOSURE WITH DROP DOWN TAMPER INDICATING BAND AND RELATED CONTAINER FINISH

[75] Inventor: John N. Banich, Sr., Chicago, Ill.

[73] Assignee: Continental White Cap., Inc., Norwalk, Conn.

[21] Appl. No.: 393,121

[22] Filed: Aug. 14, 1989

[51] Int. Cl.[5] ..... B65D 41/34

[52] U.S. Cl. ..... 215/252; 215/258

[58] Field of Search ..... 215/252, 258

[56] References Cited

U.S. PATENT DOCUMENTS

| | | | |
|---|---|---|---|
| 3,158,278 | 2/1960 | Knapp et al. . | |
| 3,199,703 | 6/1964 | Alexander . | |
| 3,235,115 | 2/1966 | Duke . | |
| 3,374,913 | 3/1968 | Zipper . | |
| 3,455,478 | 7/1969 | Fields et al. . | |
| 3,484,012 | 12/1969 | White et al. . | |
| 3,685,677 | 8/1972 | Westfall . | |
| 4,278,180 | 7/1981 | Willis | 215/252 |
| 4,372,456 | 2/1983 | Guala | 215/252 |
| 4,461,391 | 7/1984 | Davis | 215/252 |
| 4,494,664 | 1/1985 | Guala | 215/252 |
| 4,505,401 | 3/1985 | Berglund | 215/252 |
| 4,813,561 | 3/1989 | Ochs | 215/252 |

*Primary Examiner*—Stephen Marcus
*Assistant Examiner*—Nova Stucker
*Attorney, Agent, or Firm*—Charles E. Brown; Paul Shapiro; Charles A. Brown

[57] ABSTRACT

This relates to a closure with a drop down tamper indicating band and a related container finish. The container is provided with a neck finish which includes below threads thereof a radially outwardly projecting bead which carries a plurality of circumferentially spaced, vertical nibs. The closure is constructed to be rotated relative to the container neck finish during the removal thereof and includes a lower tamper indicating band which is secured to the closure skirt by a plurality of rupturable bridges. The band has formed on the inner surface thereof a plurality of circumferentially spaced, radially inwardly projecting, axial splines which may be considered as arranged in pairs for receiving therebetween a container nib. The circumferential spacing of each pair of splines is greater than the circumferential extent of a nib so that there is a very loose connection between the nibs and the splines which prevent only rotation of the tamper indicating band when the closure is being removed to open the container. When the bridges rupture, the tamper indicating band is free to drop down below the container neck finish and to seat on the container shoulder. The closure cannot be reapplied and the tamper indicating band loosely assembled therewith to give the appearance that the container has not been opened.

9 Claims, 3 Drawing Sheets

CLOSURE WITH DROP DOWN TAMPER INDICATING BAND AND RELATED CONTAINER FINISH

This invention relates in general to new and useful improvements in closures with tamper indicating bands, and more specifically to a closure wherein the tamper indicating band drops down when it detaches from the closure during the removal of the closure from a container.

There are quite a few closures with tamper indicating bands in the marketplace today. Some of these closures depend on interference of the tamper indicating band with a horizontal bead on the container while other tamper indicating bands depend on a ratchet configuration of the container and closure. While there are several closures that work well, there are several drawbacks with the existing tamper indicating band configurations, i.e. improper fit or tolerances of the tamper indicating band and the container bead can allow the tamper indicating band to slip over or "tire" over the container bead and come off of the container with the closure and tamper indicating band still intact, thus defeating the purpose of the tamper indicating band.

Another drawback of existing closures is that once the closure is removed from the container and the tamper indicating band breaks as intended, the closure can be carefully reapplied to the container, the tamper indicating band can be brought up to the container bead, and the interference between the tamper indicating band and the container bead can hold the tamper indicating band up, thus giving the package the appearance of being secure or unopened.

A distinct disadvantage of the ratchet type closure is that it requires unscrewing mold cores for the removal of the part from a mold. This requires that the tamper indicating band be placed outboard of the closure body. When removing the closure from a container it is difficult to grasp the closure without grasping the tamper indicating band at the same time, thus increasing the removal torque of the closure or total package.

Both systems require extensive amounts of glass or plastic in an area where dimension for functionality of the complete package is extremely difficult to control by the container manufacturer.

In accordance with this invention, the container is provided with vertical nibs while the tamper indicating band is provided with vertical splines for receiving therebetween a nib in a manner to allow for a true drop down tamper feature with no possibility of container interference with the tamper indicating band to hold the tamper indicating band up against the reapplied closure to give the closure and container the appearance of an unopened package.

Further, it is urged that the container construction is one which should meet with little resistance from glass or plastic manufacturers since the tight tolerances now required by the other closure constructions are greatly loosened up.

With the above and other objects in view that will hereinafter appear, the nature of the invention will be more clearly understood by reference to the following detailed description, the appended claims, and the several views illustrated in the accompanying drawings.

FIGS. 8–12 are enlarged fragmentary vertical sectional views taken through different types of closures all incorporating a tamper indicating band formed in accordance with this invention and applicable to the container of FIG. 1.

Figure 1:
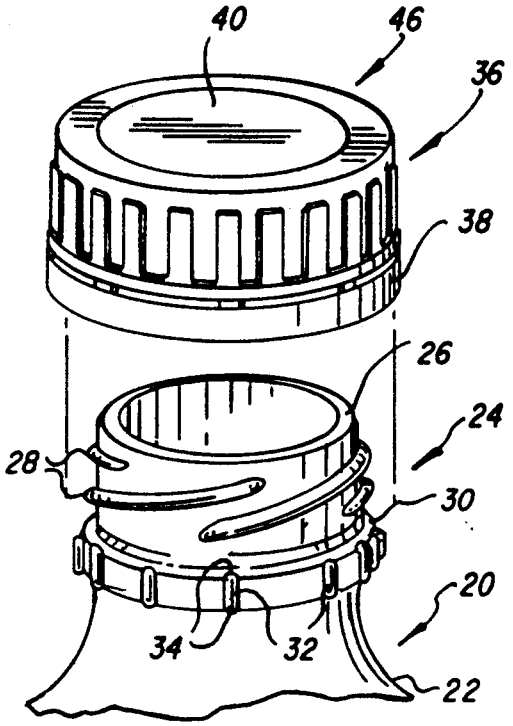
FIG. 1 is an exploded perspective view showing the closure and container neck finish prior to assembly.
Figure 2:
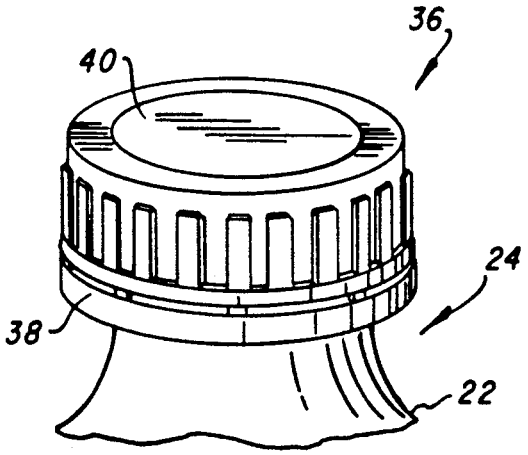
FIG. 2 is a top perspective view showing the closure applied to the container.

Referring now to the drawings in detail, it will be seen that there is illustrated in FIG. 1 a container 20 having a shoulder 22 from which there extends upwardly a neck finish generally identified by the numeral 24. The neck finish 24 is tubular and includes an end sealing surface 26. Below the end sealing surface 26 there are thread means illustrated in the form of a plurality of interrupted thread segments 28 although the threads could be continuous.

Neck finish 24 also includes a specific feature of this invention in the form of a radially outwardly projecting bead 30 which is provided with a plurality of circumferentially spaced, radially outwardly projecting, vertically extending nibs 32. Preferably the nibs 32 are provided with rounded upper and lower ends 34.

In FIG. 1 there is also illustrated a closure which is the subject of this invention, the closure being generally identified by the numeral 36 and being applicable to the container neck finish 24. The closure 36 is provided with a tamper indicating band 38 which is the specific subject of this invention. As will be readily apparent hereinafter, the closure 36 is of a basic construction which may be varied without departing from the spirit and scope of this invention.

Figure 6:
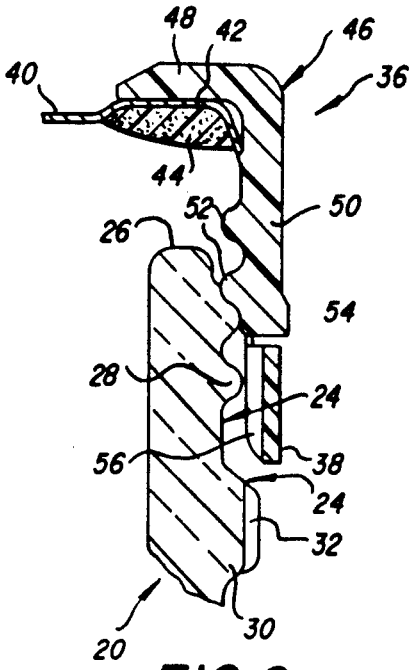
FIG. 6 is an enlarged fragmentary vertical sectional view showing the relationship of the closure and the container neck finish as application of the closure to the container is initiated.
Figure 7:
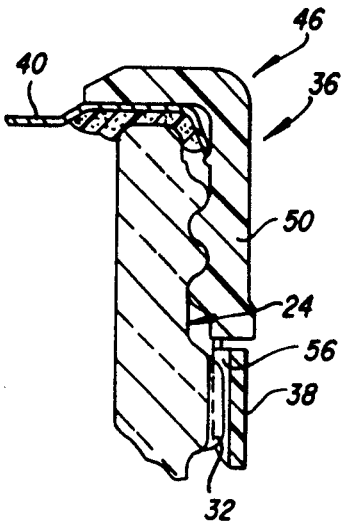
FIG. 7 is an enlarged fragmentary vertical sectional view taken through the container neck finish and the closure with the closure fully applied to the container and the tamper indicating band locked to the container neck finish.
Figure 8:
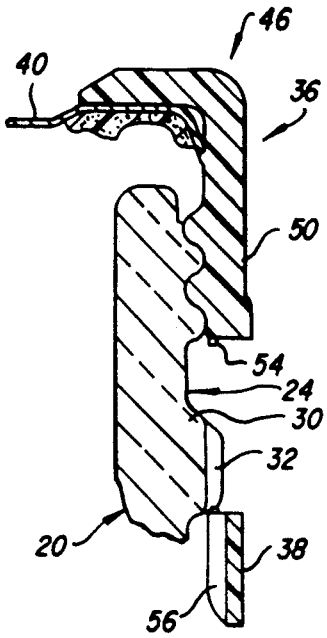
FIG. 8 is an enlarged fragmentary vertical sectional view showing the closure as it is being unthreaded from the container neck finish with the tamper indicating band having been released from the closure skirt and having dropped down relative to the container nibs.

Referring now to FIGS. 6–8, it will be seen that the closure 36 includes a metal end panel 40 which is configurated to define a downwardly opening peripheral channel 42 in which there is seated a suitable sealing compound of an annular configuration which is engageable in sealing relation with the end sealing surface 26 to form a seal with the container neck finish 24 as is best shown in FIG. 7.

The end panel 40 is carried by a ring member generally identified by the numeral 46 which is preferably of a molded plastic construction and includes an annular end portion 48 and a generally cylindrical skirt 50. The interior of the skirt 50 is provided with thread means which may also be of either the interrupted type shown in FIG. 1 as at 28 or may be continuous.

Figure 4:
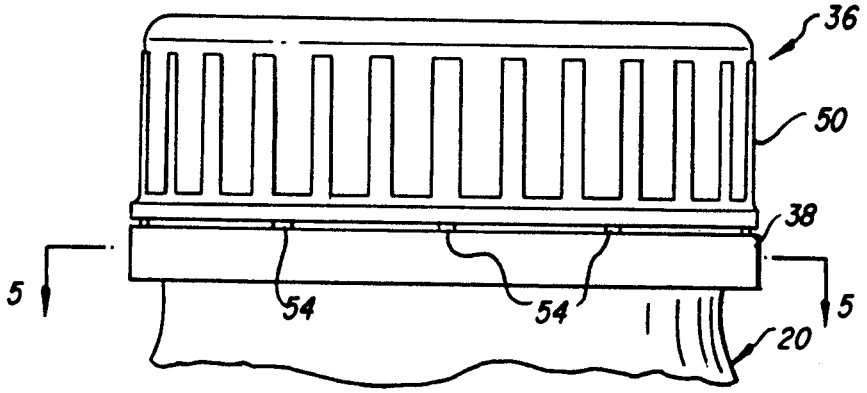
FIG. 4 is an enlarged fragmentary elevational view of the closure applied to the container and shows the manner in which the tamper indicating band is detachably secured to the closure skirt.

The tamper indicating band 38 is integrally molded with the lower edge of the skirt 50. The tamper indicating band 38 is generally axially spaced from the lower edge of the skirt 50 and is secured thereto by a plurality of circumferentially spaced, rupturable bridges 54 which are best shown in FIG. 4.

Figure 5:
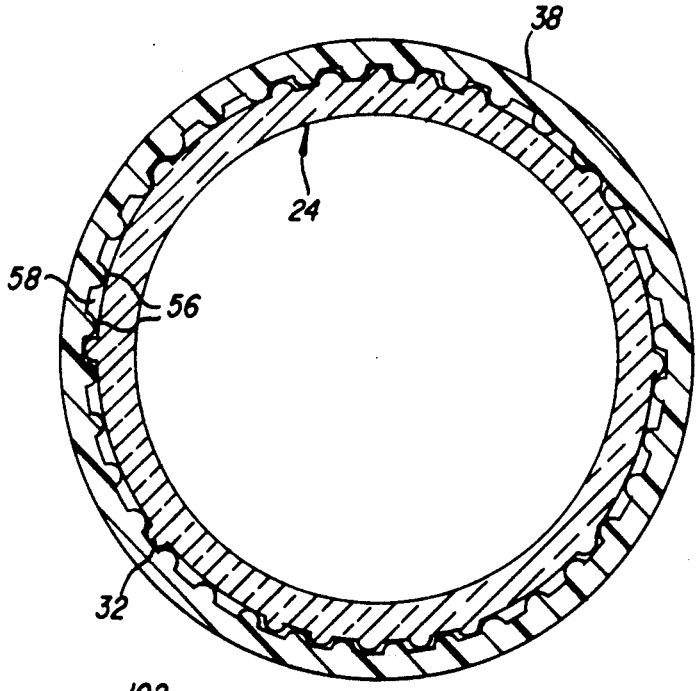
FIG. 5 is a transverse horizontal sectional view taken generally along the line 5—5 of FIG. 4 and shows the relationship of the container nibs and the tamper indicating band splines.

As is best shown in FIGS. 5 and 6, the inner surface of the tamper indicating band 28 is provided with a plurality of radially inwardly projecting, vertical splines 56. The splines 56, as is best shown in FIG. 5, may be considered as arranged in pairs and defined therebetween an axially extending recess 58 of a circumferential width greater than the circumferential extent of each of the nibs 32. Thus, as is best shown in FIG. 5, when the closure 36 is fully seated on the container 20, each of the nibs 32 will be loosely received between a pair of the splines 56 in the respective groove 58 positioned between the pair of splines 56.

Further, as is clearly shown in FIG. 6, the radial projection of the bead 30 is one wherein the nibs 32 are disposed radially outwardly of the thread means 28.

It is to be understood that in the assemblying of the closure 36 with the container 20, the closure 36 is automatically dropped down and seated onto the container neck finish 24 in the position shown in FIG. 6. Thereafter, the closure 36 is preferably fully applied on the container by pressing the closure 36 downwardly to the position shown in FIG. 7. At this time the tamper indicating band 38 is fully telescoped over the nibs 32 with the nibs 32 being positioned between pairs of splines 56 to lock the tamper indicating band 38 to the container neck finish 24 by the interaction of the nibs 32 and the splines 56.

Figure 3:
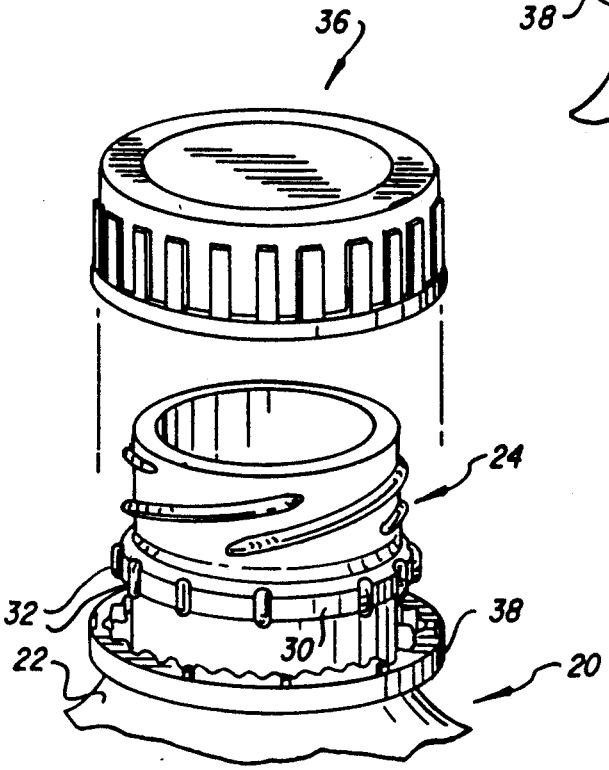
FIG. 3 is an exploded perspective view showing the closure removed from the container with the tamper indicating band having dropped down onto the container shoulder.

The closure 36 is to be removed from the container 20 by unthreading the closure 36 from the container neck finish 24 as is generally shown in FIG. 8. Since the tamper indicating band 38 is locked against rotation with the closure skirt 50, when the skirt 50 rotates relative to the fixed tamper indicating band 38, the bridges 54 are ruptured and thus the tamper indicating band 38 is released from the skirt 50. Because there is only a loose fit between the nibs 32 and the splines 56, the tamper indicating band 38 is in no way tightly interlocked with the container 20 and thus when the tamper indicating band 38 is released from the closure 36, it freely drops downwardly relative to the bead 30 and the nibs 32 so as to seat on the container shoulder 22 as is best shown in FIG. 3.

Further, and most important, when the closure 36 is reapplied to the container 20, the tamper indicating band 38 cannot be maintained in association with the skirt 50 of the closure by lifting the same up into its original position. There is nothing to hold it in its elevated position and thus as soon as it is released, it will again fall back clear of the nibs 32 and into seating engagement on the shoulder 22.

Figure 9:
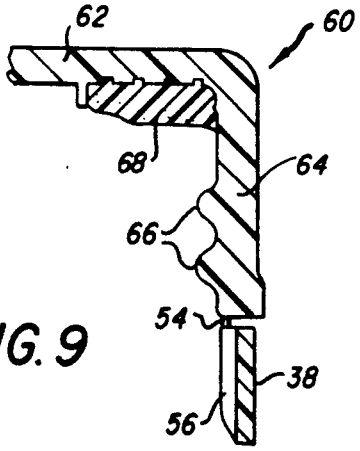

As pointed out above, the tamper indicating band 38 may be associated with different types of conventional closure constructions. In FIG. 9 there is illustrated a closure 60 wherein an end panel 62 thereof is molded integrally with a plastic skirt 64 with which the bridges 54 and the tamper indicating band 38 are also integrally molded. The interior of the skirt 64 will be provided with thread means 66 which may either be in the form of interrupted segments or continuous. Also, the end panel 62 will carry a suitable ring or band of compound 68 for sealing engagement with the end sealing surface 26.

Figure 10:
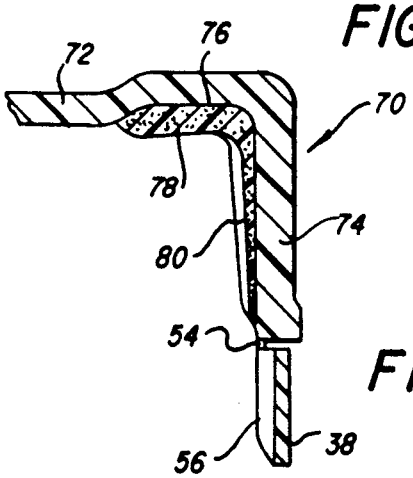

In FIG. 10 there is illustrated a conventional type of closure generally identified by the numeral 70. The closure 70 is of a one piece molded plastic construction and includes an end panel 72 which is joined to a generally cylindrical skirt 74 with there being a downwardly opening channel 76 at the intersection of the end panel 72 with the skirt 74. A suitable sealing compound 78 is seated in the channel 76 for sealing engagement with the end sealing surface 26 of the container 20. Further, the sealing compound 78 has a portion 80 which forms a lining for the interior of the skirt 74. The skirt 74 is free of thread means.

The tamper indicating band 38 is integrally molded with the skirt 74 and joined thereto by the bridges 54 in the previously described manner.

The closure 70 is pressed on to the container neck finish 24 and the thread means 28 are forced into the sealing compound portion 80 so as to interlock the closure 70 with the container neck finish 24. At the same time the nibs 32 are received between the splines 56 so as to lock the tamper indicating band 38 against rotation relative to the container 20.

Figure 11:
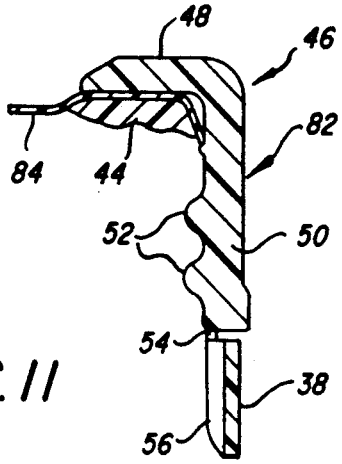

Referring now to FIG. 11, it will be seen that there is illustrated a closure generally identified by the numeral 82 which is very similar to the closure 36. The closure 82 differs from the closure 36 only in that in lieu of the metal end panel 40, there is an end panel 84 which is formed of plastic. The closure 82 incorporates the band of sealing compound 44 and includes the plastic molded ring 46 having the integral skirt 50 with which the tamper indicating band 38 is integrally joined by way of the bridges 54.

Figure 12:
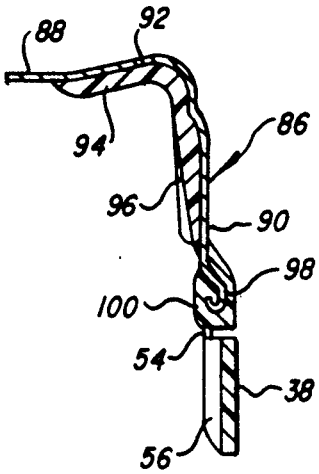

Referring now to FIG. 12, it will be seen that there is illustrated another closure generally identified by the numeral 86. The closure 86 is primarily formed of metal and includes an integral metal end panel 88 and skirt 90. There is a downwardly opening channel 92 in the corner between the end panel 88 and the skirt 90 and seated in the channel 92 is a suitable sealing compound 94 similar to the sealing compound 78 and having a portion 96 lining the interior of the skirt 90.

The skirt 90 has a lower offset extension 98 which is imbedded in a molded plastic band 100 with which the tamper indicating band 38 is integrally molded and to which the tamper indicating band 38 is attached by way of the bridges 54.

The closure 86 is pressed to the container neck finish 24 in the same manner as that described with respect to the closure 70.

Figure 13:
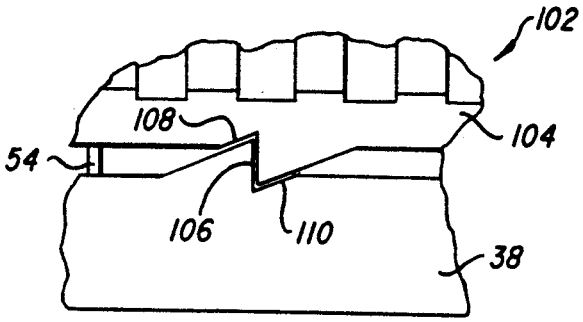
FIG. 13 is an enlarged fragmentary elevational view of another form of closure wherein there is a ratchet type driving lug connection between the closure skirt and tamper indicating band.

Referring now to FIG. 13, it will be seen that there is illustrated a closure 102 which is specifically constructed to be rotated relative to the container neck finish 24 during application of the closure. To this end, the tamper indicating band 38 is releasably connected to a skirt 104 of the closure 102 by way of a ratchet type, one way drive 106 wherein during the application of the closure 102, the tamper indicating band 38 is driven to rotate with the closure skirt 104 but whereas when the closure 102 is to be removed, the tamper indicating band 38 will remain stationary and bridges 54 initially connecting the tamper indicating band 38 to the closure skirt 104 will rupture to permit the tamper indicating band 38 to drop down. Further, the ratchet drive 106 is provided with sloping surfaces 108, 110 which force the tamper indicating band 38 downwardly when the closure 102 is being removed thereby facilitating the rupture of the bridges 54.

Although only several preferred embodiments of the closure and a specific embodiment of the container neck finish have been specifically disclosed and claimed herein, it is to be understood that minor variations may be made in both the closures and the container neck finish without departing from the spirit and scope of the invention as defined by the appended claims.

I claim:

1. A container neck finish and cooperating closure combination, said neck finish including an end sealing surface, a peripheral closure retaining surface below said end sealing surface, and a tamper indicating band receiving portion below said closure retaining surface, said tamper indicating band receiving portion including a plurality of circumferentially spaced, axially extending, and radially outwardly projecting nibs, said nibs having upper ends free of all axial obstructions and lower ends free of adjacent axial obstruction; and said closure including an end panel having sealing means for sealing engagement with said end sealing surface, a depending skirt having closure retaining means for engaging said closure retaining surface, and a releasable tamper indicating band depending from said skirt in an axial spacing from said end panel to engage said tamper indicating band receiving portion, said tamper indicating band having pairs of radially inwardly projecting and axially extending splines, said splines being free of axial obstructions and loosely receiving therebetween ones of said nibs to lock said tamper indicating band against removal rotation relative to said container with said skirt while permitting said tamper indicating band when released from said skirt to freely drop away from said skirt a distance to clearly indicate tampering.

2. The combination of claim 1 wherein the spacing between splines of each pair of splines is greater than the circumferential extent of a respective one of said nibs whereby said tamper indicating band is free to drop below said nibs when said tamper indicating band is released from said skirt.

3. The combination of claim 2 wherein said tamper indicating band is releasably connected to said skirt by rupturable bridges.

4. The combination of claim 1 wherein said nibs are carried by a radially outwardly projecting annular bead which spaces said nibs radially outwardly of said closure retaining surface.

5. The combination of claim 1 wherein said closure is of the press-on twist-off type.

6. The combination of claim 5 wherein said closure retaining surface includes threads.

7. The combination of claim 5 wherein said closure retaining surface includes threads, and said skirt is initially free of threads.

8. The combination of claim 5 wherein said closure retaining surface includes threads, and said skirt is initially provided with internal threads.

9. The combination of claim 1 wherein there is a threaded connection between said container neck finish and said closure skirt, and there is a one way ratchet drive between said skirt and said tamper indicating band.

* * * * *